US006776137B2

(12) United States Patent
Kawai et al.

(10) Patent No.: US 6,776,137 B2
(45) Date of Patent: Aug. 17, 2004

(54) THROTTLE BODIES WITH METAL PLATES FOR SUPPORTING GEAR SHAFTS

(75) Inventors: Shinji Kawai, Aichi-ken (JP); Hisashi Kino, Aichi-ken (JP)

(73) Assignee: Aisan Kogyo Kabushiki Kaisha, Obu (JP)

( * ) Notice: Subject to any disclaimer, the term of this patent is extended or adjusted under 35 U.S.C. 154(b) by 0 days.

(21) Appl. No.: 10/702,426

(22) Filed: Nov. 7, 2003

(65) Prior Publication Data

US 2004/0089266 A1 May 13, 2004

(30) Foreign Application Priority Data

Aug. 11, 2002 (JP) ..... 2002-361478

(51) Int. Cl.[7] ..... F02D 9/10
(52) U.S. Cl. ..... 123/399; 251/305
(58) Field of Search ..... 123/361, 399; 251/305, 307

(56) References Cited

U.S. PATENT DOCUMENTS 4,192,398 A * 3/1980 Hunt ..... 123/361
6,039,027 A * 3/2000 Sato et al. ..... 123/399
2003/0178004 A1 * 9/2003 Keefover et al. ..... 251/305

FOREIGN PATENT DOCUMENTS

JP 2001303983 10/2001

* cited by examiner

*Primary Examiner*—Erick R. Solis
(74) *Attorney, Agent, or Firm*—Dennison, Schultz, Dougherty & MacDonald

(57) ABSTRACT

A throttle body has a main body made of resin. A throttle valve, a motor, and a gear mechanism, are disposed within the main body, so that the rotation of the motor is transmitted to the throttle valve via the gear mechanism. The gear mechanism includes a drive gear, mounted to an output shaft of the motor, and an intermediate gear disposed between the drive gear and the throttle valve. A metal plate is mounted to a motor casing of the motor and the intermediate gear is mounted to the metal plate. The interface between the intermediate gear and the throttle valve is adjustable.

15 Claims, 2 Drawing Sheets

THROTTLE BODIES WITH METAL PLATES FOR SUPPORTING GEAR SHAFTS

This application claims priority to Japanese patent application serial number 2002-361478, the contents of which are incorporated herein by reference.

BACKGROUND OF THE INVENTION

1. Field of the Invention

The present invention relates to throttle bodies that have throttle valves actuated by motors for controlling the rotational speed of internal combustion engines. In particular, the present invention relates to throttle bodied that have metal plates for supporting gear shafts of gear mechanisms that transmit rotation of motors to throttle valves.

2. Description of the Related Art

There are known throttle bodies that have motor actuated throttle valves. For example, Japanese Laid-Open Patent Publication No. 2001-303983 teaches a throttle body in which a throttle valve, a throttle shaft, a motor, and a gear mechanism, are disposed. The throttle body of this publication is used as an automobile part and is modified to provide a lightweight structure by using resin as the material of the throttle body. The throttle valve is secured to the throttle shaft and the motor rotatably drives the throttle shaft. A gear mechanism, comprising a plurality of gears and gear support shafts, serves to transmit the driving force of the motor to the throttle shaft.

However, by using a resin material for the throttle body, potential deformation of the throttle body may occur due to residual molding stress and/or strain or due to forces applied to the throttle body during the assembly process. This deformation could cause a change in the relative distances between the gear shafts. As a result, the gear teeth may be unintentionally stressed, resulting in excessively wear and rough operation of the gears. Therefore, in order to solve these problems, the above publication proposes to use a single metal plate in order to support all of the gear shafts.

However, there still exists a possibility of deformation because the metal plate must be relatively large in order to support all of the individual gear shafts. The deformation can occur when the metal plate is secured to the throttle body or during the molding process of the throttle body itself, since the throttle body is formed integrally with the metal plate as an insert molding process. Unfortunately, a problem exists in that it is very difficult to correct any changes in the distance caused due to the deformation of the metal plate. In addition, use of a relatively large sized metal plate may result in increased material costs.

SUMMARY OF THE INVENTION

It is accordingly an object of the present invention to teach improved techniques for reducing the material cost of a throttle body and facilitating correction of distance between gears of a gear mechanism of the throttle body.

According to one aspect of the present teachings, throttle bodies include a main body made of a lightweight material; preferably resin, for example, ABS resin. A throttle valve, a motor, and a gear mechanism, are disposed within the main body, so that the rotation of the motor is transmitted to the throttle valve via the gear mechanism. The gear mechanism includes a drive gear mounted to an output shaft of the motor and an intermediate gear disposed between the drive gear and the throttle valve. A metal plate, e.g., preferably a steel plate, is mounted to a motor casing of the motor and the intermediate gear is mounted to the metal plate. An adjusting device serves to adjust the position of the intermediate gear laterally across a face of the main body.

Because the throttle gear is mounted to the metal plate that is in turn mounted to the motor casing, the distance between the drive gear of the motor and the intermediate gear can be reliably maintained to a suitable length. In addition, because the adjusting device can adjust the position of the intermediate gear laterally across the face of the main body, the position of the intermediate gear relative to an element that is mounted on or supported by the main body can be suitably adjusted. In particular, the position relative to a throttle gear that engages the intermediate gear can be adjusted. As a result, any undesired wear of the gears within the gear mechanism due to the incorrect spacing of gears could be reduced or minimized. In addition, because the metal plate only supports the intermediate gear and is mounted to the motor casing, the metal plate may have a relatively small overall size. Therefore, the throttle body can be manufactured at a lower cost while still providing overall improved controllability of the throttle valve.

In still another aspect of the present teachings, throttle bodies further include a fixing device that serves to fix the metal plate in position relative to the main body. In this construction, it is advantageous that the adjusting mechanism serves to adjust the relative position between the metal plate and the main body in order to adjust the position of the intermediate gear relative to an element that is mounted on or supported by the main body. With this construction, the positions of the drive gear and the intermediate gear can be simultaneously adjusted relative to the main body.

Preferably, the metal plate is fixed in position relative to the motor casing and the intermediate gear is rotatably mounted on a gear shaft that is secured to the metal plate.

In further aspect of the present teachings, the fixing device comprises a screw(s) and the adjusting mechanism comprises at least one mounting hole formed in the metal plate. The mounting hole(s) is(are) adapted to receive the fixing device and in one aspect has an elongated configuration having a length that is greater than the width of the mounting hole. Therefore, the adjusting mechanism may have a relatively simple configuration and a relatively low number of parts.

Preferably, the mounting hole(s) is(are) elongated in a circumferential direction substantially about the output shaft of the motor.

Preferably, the screw (s) engages a threaded hole(s) that is(are) formed in the main body.

In a still further aspect of the present teachings, the gear mechanism additionally includes a throttle gear that is coupled to the throttle valve and is rotatable with the throttle valve. The throttle gear engages the intermediate gear. Therefore, by adjusting the position of the intermediate gear, the interface between the intermediate gear and the throttle gear may be suitably established.

DETAILED DESCRIPTION OF THE INVENTION

Each of the additional features and teachings disclosed above and below may be utilized separately or in conjunction with other features and teachings to provide improved throttle bodies and methods of using such throttle bodies. Representative examples of the present invention, which examples utilize many of these additional features and teachings both separately and in conjunction, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

Figure 1:
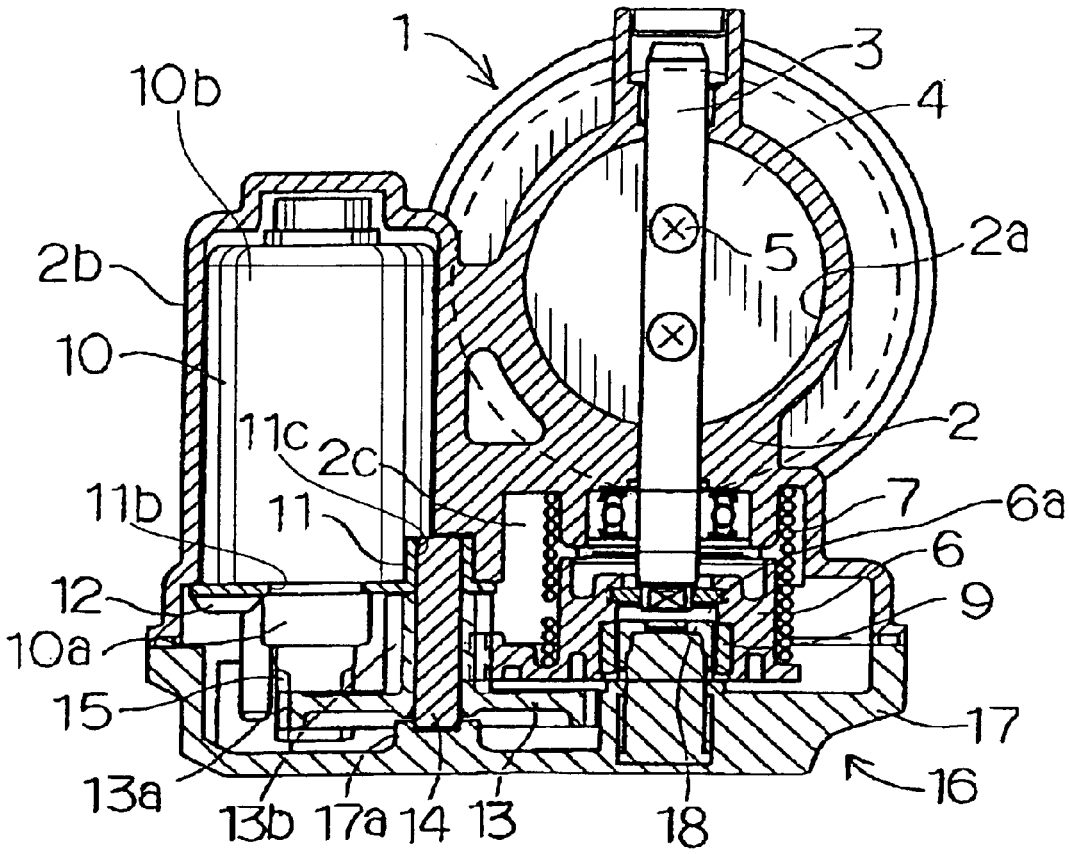
FIG. 1 is a cross sectional view of a representative throttle body according to the present invention.
Figure 2:
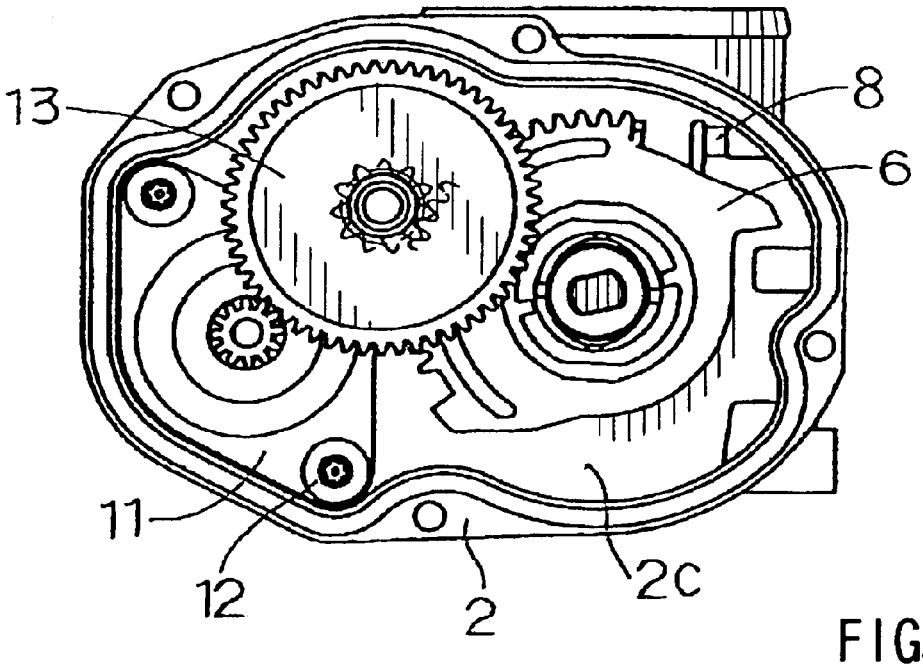
FIG. 2 is a side view of a main body of the throttle body with a cover removed.
Figure 3:
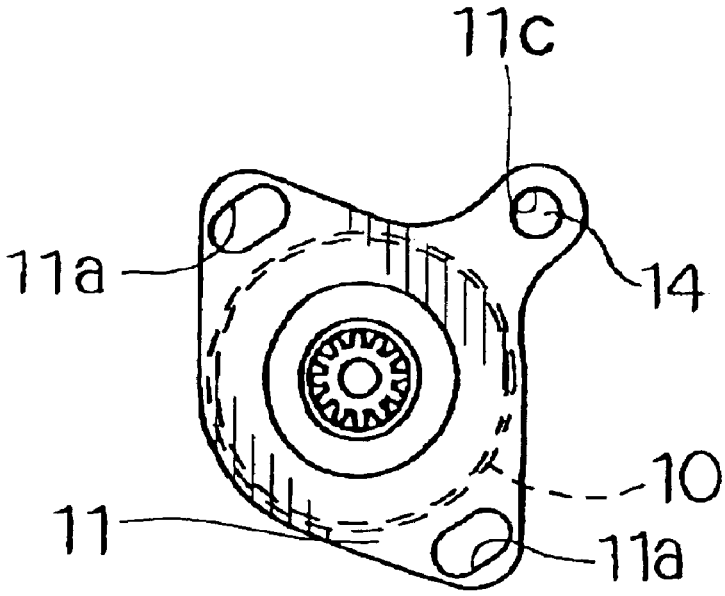
FIG. 3 is a side view of a metal plate of the throttle body.

A representative embodiment will now be described with reference to the drawings. Referring to FIGS. 1 to 3, a representative throttle body 1 includes a main body 2 that is made of a lightweight molded material, preferably a synthetic resin such as ABS resin, by using a suitable molding process, preferably an injection molding process. An intake air channel 2*a* is formed in the main body 2. A throttle shaft 3 is rotatably supported within the main body 2 and extends across the intake air channel 2*a*. A throttle valve 4 is disposed within the intake air channel 2*a* and is secured to the throttle shaft 3 via fastening devices, preferably screws 5. As the throttle shaft 3 rotates, the throttle valve 4 rotates within the intake air channel 2*a*, so that the amount of air flowing through the intake air channel 2*a* can be controlled. A throttle gear 6 is secured to one end (the lower end as viewed in FIG. 1) of the throttle shaft 3. A biasing device, shown as a torsion coil spring 7, is disposed within the main body 2 and serves to bias the throttle valve 4 in the closing direction. To achieve this result, one end of the torsion coil spring 7 is attached to the throttle gear 6. The other end of the torsion coil spring 7 is attached to the main body 2. The torsion coil spring 7 biases the throttle valve 4 via the throttle gear 6.

An adjusting means, preferably a screw 8, is mounted within the main body 2 and is positioned to oppose to the throttle gear 6 in a rotational direction, preferably in the closing direction of the throttle valve 4. Therefore, as the throttle gear 5 rotates in the closing direction, the throttle gear 6 contacts one end of the adjusting screw 8 so that the throttle gear 6, and subsequently the throttle valve 4, is inhibited from further rotation. The adjusting screw 8 determines the full-close position of the throttle valve 5. Additionally, magnets 9 are fitted into recesses 6*a* formed in the throttle gear 6 for a throttle sensor 18 system used to determine the physical orientation of the throttle valve 4.

Referring to FIG. 1, the main body 2 includes a substantially cylindrical cavity portion 2*b* that defines a space for receiving a motor 10. A metal plate 11 is fixedly joined to one axial end (the lower end as viewed in FIG. 1) of a motor casing 10*b* of the motor 10 by using appropriate bonding technique, such as welding. Alternatively, the metal plate 11 may be joined to the motor casing 10*b* by fastening means; some examples include screws, rivets, spring clips, spot welding, or snap fitting, among others. In addition, the metal plate 11 may be formed integrally with the motor casing 10.

Figure 4:
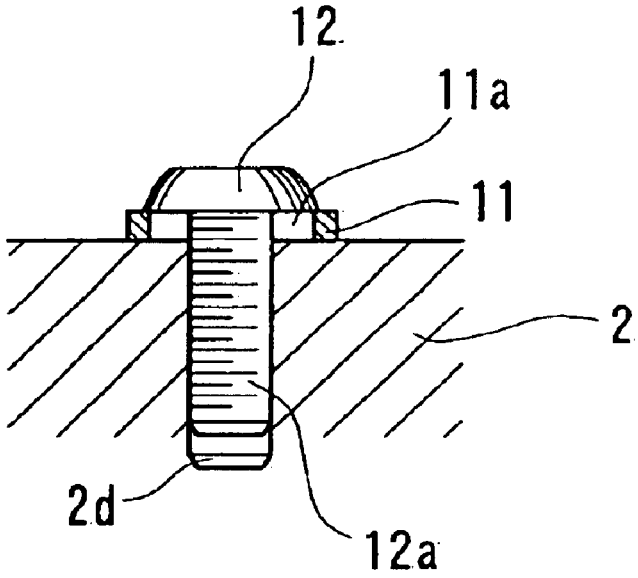
FIG. 4 is a sectional view showing the operation of one of mounting holes of the metal plate.

As shown in FIG. 3, the metal plate 11 has a substantially rhomboidal configuration with rounded points of intersected and has a circular central hole 11*b* through which an output shaft 10*a* of the motor 10 extends (see FIG. 1). A pair of mounting holes 11*a* are formed at both ends on oppose sides in the diametrical direction of the metal plate 11. The metal plate 11 is secured to the main body 12 by inserting screws 12 into the mounting holes 11*a* and tightening the screws 12 into corresponding threaded holes 2*d* (one threaded hole 2*d* is shown in FIG. 4) formed in the main body 2. As shown in FIG. 3, each of the mounting holes 11*a* has a configuration elongated in the circumferential direction (about the axis of the central hole 11*b*), so that the angular position of the metal plate 11 about the axis of the central hole 11*b* relative to the main body 2 can be adjusted within a range equal to the circumferential length of a mounting hole 11*a* minus the length of the diameter of a shank 12*a* (see FIG. 4) of the screw 12. A gear shaft 14 is inserted into an insertion hole 11*c* formed in the metal plate 11. An appropriate fixing technique, some examples of which include threading, gluing, brazing, crimping, and press fitting, fixes the gear shaft 14 within the insertion hole 11*c*. The insertion hole 11*c* is positioned at one end of the metal plate 11 in a direction radially outward from the axis of the central hole 11*b*. In the current embodiment shown, the radial direction is approximately perpendicular to a line connecting the two mounting holes 11*a* with the axis of the central hole 11*b*, but this particular orientation is specific to this embodiment and many other orientations can also be used. Because, the gear shaft 14 is fixed to the metal plate 11, the angular position of the gear shaft 14 about a drive gear 15 that is fixed to the output shaft 10*a* of the motor 10 can be adjusted by changing the fixing positions of the screws 12 relative to the metal plate 11 by utilizing the elongated mounting holes 11*a*.

An intermediate gear 14 is rotatably mounted on the gear shaft 14. The intermediate gear 14 has a large gear portion 13*a* and a small gear portion 13*b* that engage the drive gear 15 and the throttle gear 13, respectively. Because the angular position of the gear shaft 14 about the drive gear 15 can be adjusted as described above, the relative position of the intermediate gear 13 and the throttle gear 6 can be adjusted in order to provide a proper engagement between the intermediate gear 13 and the throttle gear 6.

Referring to FIG. 1, a cover 16 is mounted to the main body 2 in order to close an internal space 2*c* that is defined within the main body 2 in order to accommodate various internal elements of the main body 2, including but not limited to, the throttle gear 6, the intermediate gear 13, and the drive gear 15. The cover 16 includes a cover body 17. The cover body 17 has a recess 14 configured to receive and support one end of the gear shaft 14 when the cover 16 is mounted to the throttle body 2. In addition, a throttle sensor 18 is mounted on the cover body 17 prior to the mounting of the cover 16 onto the main body 2 of the throttle body 1. To this end, the throttle sensor 18 is positioned to face to the magnets 9 of the throttle gear 6 when the cover 16 is mounted to the throttle body 1. The throttle sensor 18 cooperates with the magnets 9 to output signals that represent the degree of opening of the throttle valve 4. The signals outputted from the throttle sensor 18 are transmitted to an ECU (electronic control unit) of an internal combustion engine (not shown) in order to control the operation of the engine. The motor 10 is electrically connected to an outside power source, e.g., a battery, via an electric line (not shown), which is in turn connected to the ECU, so that the rotation of the motor 10 can be controlled by the ECU.

According to the representative embodiment, the gear shaft 14 that supports the intermediate gear 13 is secured to the metal plate 11 that is secured to the motor casing 10*b*. Therefore, the metal plate 11 may have a relatively small size and may be manufactured at a lower cost due to the smaller size. In addition, the small metal plate 11 may reliably maintain the relative positions between the drive gear 15 of the motor 10 and the intermediate gear 13 without being negatively affected by either residual molding stress and/or strain or by forces applied to the throttle body 2 during the assembly process. In addition, the relative positions of the intermediate gear 13 and the throttle gear 6 can be adjusted in order to provide a proper engagement between the intermediate gear 13 and the throttle gear 6. Therefore, the drive gear 15, the intermediate gear 13, and the throttle gear 6, may properly engage with each other without causing extraordinary wear. As a result, there is improved controllability of the throttle valve 4 along with lower manufacturing cost for throttle body 1.

The above representative embodiment may be modified in various ways without departing from the scope of the present invention.

For example, although the mounting holes 11*a* of the metal plate 11 are elongated in the circumferential direction about the axis of the output shaft 10*a* of the motor 10 in the representative embodiment, the mounting holes 11*a* may be elongated in any other directions, such as radial direction of the output shaft 10*a* and a direction inclined relative to the radial direction. In addition, each mounting hole 11*a* may be configured by the combination of elongated holes extending in different directions and intersect with each other, so that the freedom of adjustment can be increased. For example, at least one mounting hole 11*a* may have a distorted configuration comprising many different shapes or combination of shapes, for example, configurations such as a crisscross configuration, a T-shaped configuration, or any other intersecting configurations. The mounting holes 11*a* are not required to be identically shaped; one mounting hole 11*a* may be elongated while the opposing mounting hole 11*a* may not be elongated.

In addition, although the screws 12 engage with the threaded holes 12*a* formed in the main body 2 in the above representative embodiment, the screws 12 may be replaced with threaded shafts that are fixed in position relative to the main body 2.

What is claimed is:

1. A throttle body comprising:

a main body made of resin;

a throttle valve, a motor and a gear mechanism disposed within the main body; so that the rotation of the motor is transmitted to the throttle valve via the gear mechanism, wherein the gear mechanism includes a drive gear mounted to an output shaft of the motor and an intermediate gear disposed between the drive gear and the throttle valve;

a metal plate mounted to a motor casing of the motor, wherein the intermediate gear is mounted to the metal plate; and an adjusting device arranged and constructed to adjust the position of the intermediate gear relative laterally across a face of the main body.

2. A throttle body as in claim 1, further including a fixing device arranged and constructed to fix the metal plate in position relative to the main body, wherein the adjusting mechanism serves to adjust the relative position between the metal plate and the main body.

3. A throttle body as in claim 2, wherein the metal plate is fixed in position relative to the motor casing.

4. A throttle body as in claim 3, further including a gear shaft that is secured to the metal plate, and the intermediate gear is rotatably mounted on the gear shaft.

5. A throttle body as in claim 4, wherein the adjusting mechanism comprises at least one mounting hole formed in the metal plate, and the mounting hole is adapted to receive a fixing device has an elongated configuration having a length that is greater than the width of the mounting hole.

6. A throttle body as in claim 5, wherein the fixing device comprises a screw.

7. A throttle body as in claim 5, wherein the mounting hole is elongated in a circumferential direction of the metal plate substantially about the axis of the output shaft of the motor.

8. A throttle body as in claim 6, wherein the screw engages a threaded hole formed in the main body.

9. A throttle body as in claim 5, wherein the gear mechanism further includes a throttle gear that is coupled to the throttle valve and is rotatable with the throttle valve, and the throttle gear engages the intermediate gear.

10. A throttle body comprising:

a main body made of resin; and a throttle valve, a motor and a gear mechanism disposed within the main body; so that the rotation of the motor is transmitted to the throttle valve via the gear mechanism, wherein the gear mechanism includes a drive gear mounted to an output shaft of the motor and an intermediate gear disposed between the drive gear and the throttle valve; and a metal plate mounted to a motor casing of the motor, wherein the intermediate gear is mounted to the metal plate; and an adjusting device arranged and constructed to adjust the position of the intermediate gear relative laterally across a face of the main body; and a fixing device arranged and constructed to fix the metal plate in position relative to the main body, wherein the adjusting mechanism serves to adjust the relative position between the metal plate and the main body; and a gear shaft secured to the metal plate, wherein the intermediate gear is rotatably mounted on the gear shaft.

11. A throttle body as in claim 10, wherein the adjusting mechanism comprises at least one mounting hole formed in the metal plate, and the mounting hole is adapted to receive the fixing device and has a distorted configuration allowing adjustment in at least one dimension in a plane parallel to the metal plate.

12. A throttle body as in claim 10, wherein the adjusting mechanism comprises at least one mounting hole formed in the metal plate, and the mounting hole is adapted to receive the fixing device and has an elongated configuration having a length that is greater than the width of the mounting hole.

13. A throttle body as in claim 10, wherein the adjusting mechanism comprises at least one mounting hole formed in the metal plate, and the mounting hole is adapted to receive the fixing device and has a t-shaped configuration allowing adjustment in at least two dimensions in a plane parallel to the metal plate.

14. A throttle body as in claim 10, wherein the gear mechanism further includes a throttle gear that is coupled to the throttle valve and is rotatable with the throttle valve, and the throttle gear engages the intermediate gear.

15. A throttle body comprising:

a main body made of resin; and a throttle valve, a motor and a gear mechanism disposed within the main body; so that the rotation of the motor is transmitted to the throttle valve via the gear mechanism, wherein the gear mechanism includes a drive gear mounted to an output shaft of the motor and an intermediate gear disposed between the drive gear and the throttle valve; and a metal plate mounted to a motor casing of the motor, wherein the intermediate gear is mounted to the metal plate; and an adjusting device arranged and constructed to adjust the position of the intermediate gear relative laterally across a face of the main body; and a fixing device arranged and constructed to fix the metal plate in position relative to the main body, wherein the adjusting mechanism serves to adjust the relative position between the metal plate and the main body; and a gear shaft secured to the metal plate, wherein the intermediate gear is rotatably mounted on the gear shaft; and wherein the gear mechanism further includes a throttle gear that is coupled to the throttle valve and is rotatable with the throttle valve, and the throttle gear engages the intermediate gear; and wherein the adjusting mechanism comprises at least one mounting hole formed in the metal plate, and the mounting hole is adapted to receive a fixing device and has a distorted configuration allowing adjustment in at least one dimension in a plane parallel to the metal plate.

* * * * *